United States Patent [19]

Herrera

[11] Patent Number: 4,577,475

[45] Date of Patent: Mar. 25, 1986

[54] PORTABLE COOLER

[76] Inventor: Samuel R. Herrera, 2303 Santa Rosa, Austin, Tex. 78702

[21] Appl. No.: 721,199

[22] Filed: Apr. 9, 1985

[51] Int. Cl.[4] ..... F25D 3/08

[52] U.S. Cl. ..... 62/457; 62/459; 62/464

[58] Field of Search ..... 62/457, 458, 459, 460, 62/464, 372; 215/13 R

[56] References Cited

U.S. PATENT DOCUMENTS

| | | | |
|---|---|---|---|
| 579,715 | 3/1897 | Lindsey et al. | 62/459 X |
| 1,613,721 | 1/1927 | Roberts | 62/459 X |
| 1,633,588 | 6/1927 | Klinenberg | 62/464 X |
| 1,670,959 | 5/1928 | Garrett | 62/459 |
| 1,757,390 | 5/1930 | Ryder | 62/459 X |
| 2,408,460 | 10/1946 | Van Doren | 62/447 X |
| 3,069,869 | 12/1952 | Mueller | 62/371 |
| 3,106,074 | 10/1963 | Amburgey, Jr. | 62/464 |
| 3,395,550 | 1/1967 | Dungan | 62/400 |
| 3,572,054 | 3/1971 | Curcio | 62/390 |
| 3,664,643 | 5/1972 | La Neve | 259/44 |

*Primary Examiner*—Lloyd L. King

*Attorney, Agent, or Firm*—Arnold, White & Durkee

[57] ABSTRACT

A portable cooler or ice chest comprising a container for ice insulated on the sides with a drain and a base compartment with insulated recesses situated beneath the container. Adapted to fit in the recesses are closable bins for storage and cooling of beverages or items. The bins are separate from the container but not by insulation.

6 Claims, 5 Drawing Figures

PORTABLE COOLER

BACKGROUND OF THE INVENTION

The present invention concerns a portable cooler or ice chest having removable storage compartments for beverages or food items. An insulated compartmented ice chest is described in U.S. Pat. No. 3,395,550 which comprised a main compartment for ice and a side or auxiliary compartment for drinking water. Portable coolers with liquid dispensing capabilities are also described in U.S. Pat. Nos. 3,069,869, 3,664,643 and 3,572,054. U.S. Pat. No. 3,069,869, for example, shows a cooler which has removable upper and lower containers. The upper container holds dry ice and the lower container may hold liquids which may be carbonated in place.

SUMMARY OF THE INVENTION

A portable cooler comprising a base compartment and an upper compartment separated by a transverse partition. The base compartment has insulated side and back walls, an insulated bottom and a top defined by the transverse partition. The front of the base compartment has at least two openings through which closable containers are slidably insertable into the base compartment. The base compartment is configured to receive and hold a plurality of closable containers, preferably in a side-by-side relation. The portable cooler further preferably comprises means for draining liquids from the upper compartment as well as from the closable containers. It is an object of the present invention to provide a portable cooler adapted for outdoor use and having a readily accessible storage capacity for liquids or items held separate from the coolant but not from the cooling effects thereof.

DESCRIPTION OF THE PREFERRED EMBODIMENTS OF THE PRESENT INVENTION

Figure 1:
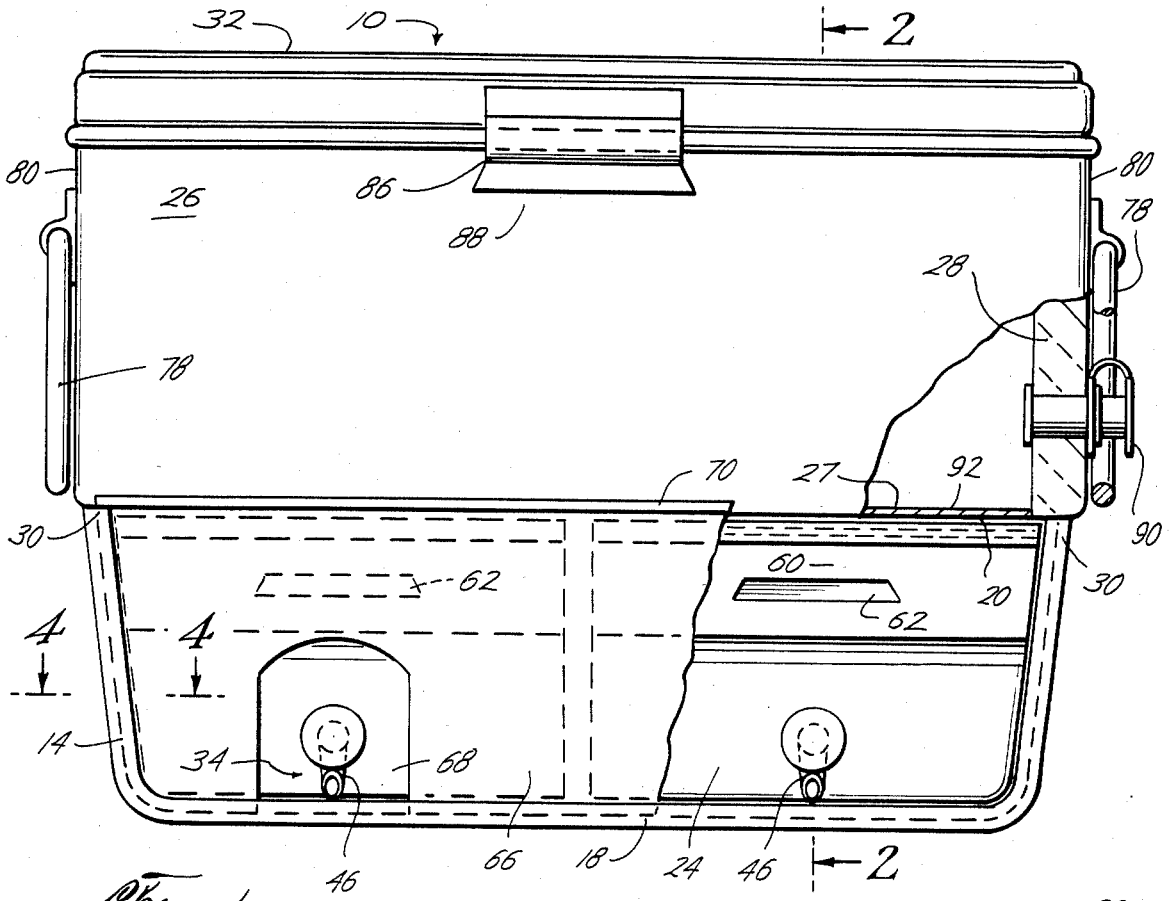
FIG. 1 is a partially cut-away front elevational view of the portable cooler of the present invention.
Figure 2:
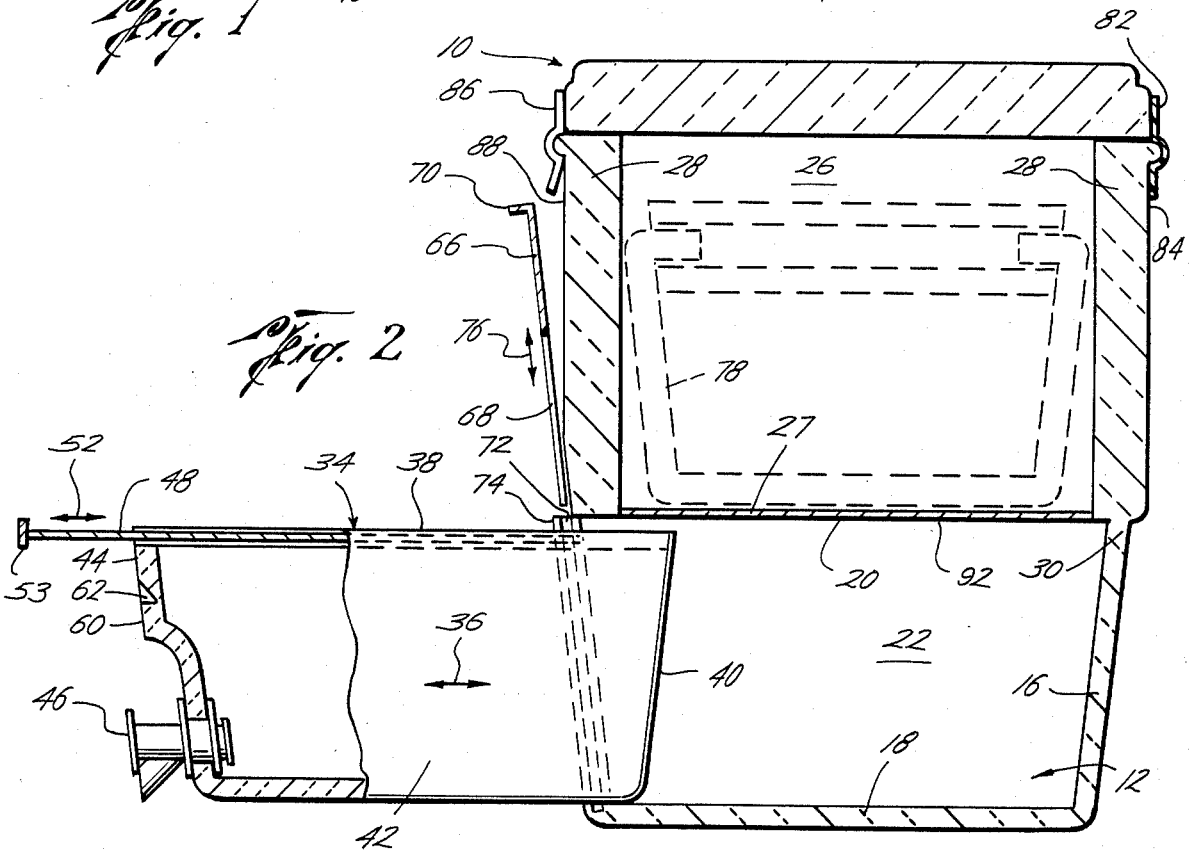
FIG. 2 is a side sectional view of the cooler of FIG. 1 taken substantially along the lines designated by the numerals 2—2 in FIG. 1.

Referring to the drawings in general and to FIGS. 1 and 2 in particular, shown therein and designated by the general reference numeral 10 is a portable cooler which is constructed in accordance with the present invention. The cooler 10 includes a base compartment 12. The base compartment 12 has insulated side walls 14, an insulated back wall 16, and insulated bottom 18 and a top 20. Also, part of the base compartment 12 and shown most clearly in FIG. 2 is a recess 22, the base compartment 12 having at least one such recess 22 although two or more are preferable. In a preferred embodiment of the invention, the front 24 of the base compartment 12 may be substantially entirely open.

A generally rectangular container 26 is situated above the base compartment 12 and has a bottom 27 and insulated walls 28 secured generally to the periphery 30 of the top 20 of the base compartment 12 and extending upwardly therefrom. A means for covering said container 26 is shown in this embodiment 10 as an insulated cover 32.

The cooler 10 further comprises a least two closable bins 34. The bins 34 are adapted to be slidably insertable through the front 24 of the base compartment 12 into the recesses 22 which are laterally accessible in a direction indicated by the arrow 36. The bins 34 have an upward opening 38 for emplacing liquids or other items and retrieving these items. Each closable bin 34 has a back wall 40, side walls 42, and a front wall 44. Each bin 34 preferably has a means for draining liquids therefrom. When a bin 34 is inserted into the recess 22 of the base compartment 12 a drip proof spigot 46 in the front wall 44 is in a position to be accessible for ready usage and provide a preferred means for draining liquids therefrom.

The bin 34 is further characterized as having a lid 48 or 50 attached to the upward opening 38. In FIG. 2 a slidable lid 48 is shown partially covering the upward opening 38. The slidable lid 48 is slidable in a direction designated by the arrow 52. The slidable lid 48 has a front portion 53 adapted to facilitate movement for removal and emplacement of liquids or items (not shown).

Figure 5:
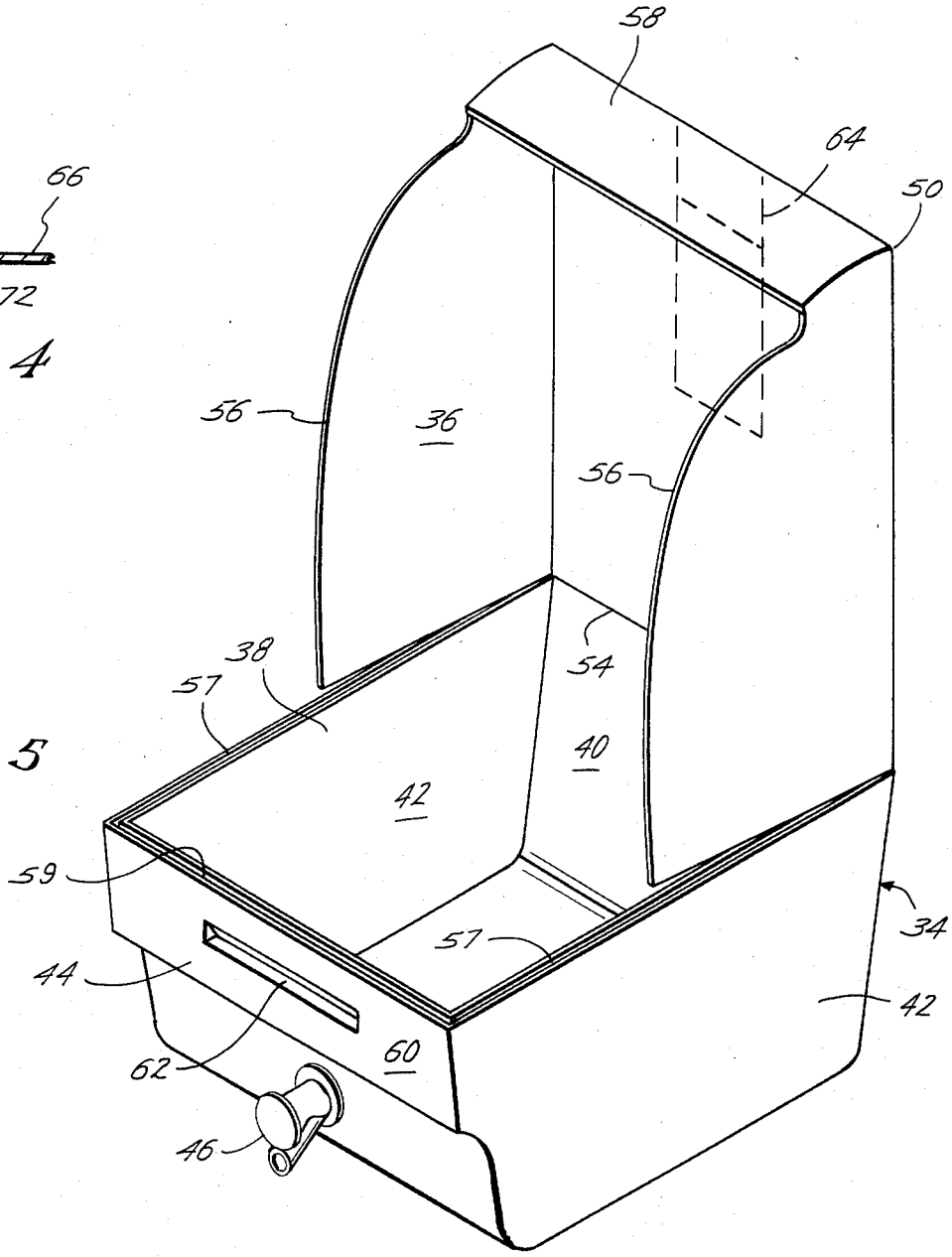
FIG. 5 is a perspective view of an embodiment of a container of the present invention.

Another embodiment of the lid 50, shown most clearly in FIG. 5, is hinged to the upward opening 38 at a portion 54 of the bin 34 back wall 40. The lid 50 may have side flaps 56, particularly adapted to fit inside a groove 57 of the side walls 42 of the bin 34 and a front flap 58 to fit inside a groove 59 of the front wall 44. The flaps 56 and 58 fit closely enough to the walls 42 and 44 to substantially prevent liquid overflow from the bin 34.

An upper outer portion 60 of the front wall 44 of each bin 34 may have a gripping indentation 62 as shown in FIGS. 1 and 2 to facilitate removal of the bin 34 from a recess 22 of the base compartment 12. Each hinged lid 50 may also have a gripping indentation 64 (shown implantation in FIG. 5) adapted to facilitate raising the lid 50.

Figure 3:
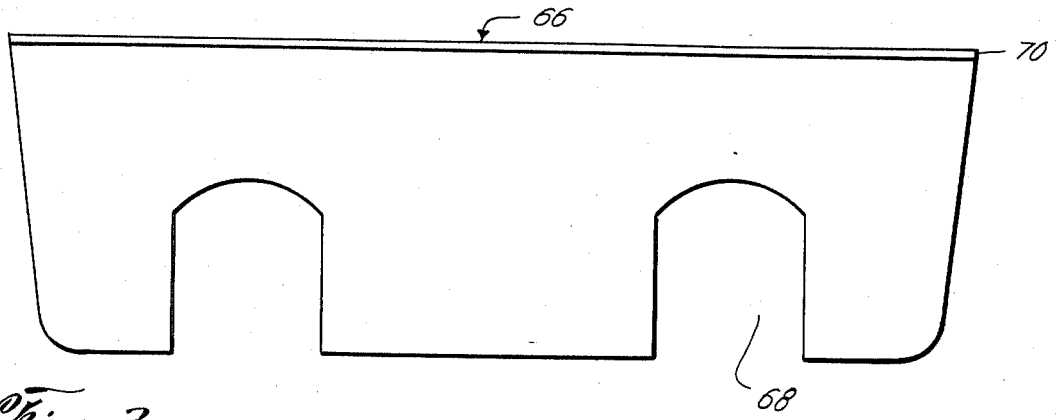
FIG. 3 is a front elevational view of a sliding retainer plate of the present invention.
Figure 4:
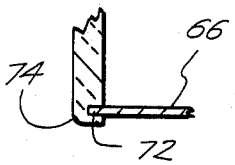
FIG. 4 is a downward sectional view of a wall of the cooler of FIG. 1 taken substantially along the lines designated by the numerals 4—4 in FIG. 1.

The bins 34, when inserted into the recesses 22 of the base compartment 12 may be retained in the inserted positions in several ways. A preferred means for retaining the bins 34 is shown in FIGS. 1, 2 and 3 in the form of a sliding retainer plate 66. The sliding retainer plate 66 is shown in an inserted position in FIG. 1, and in a partially withdrawn position in FIG. 2. FIG. 3 shows a front view of the retainer plate 66 which, in some instances, may be made of an insulating material. The retainer plate 66 has insets 68 to fit around the drip proof spigots 46, and an upper lip 70 to facilitate removal and insertion. The retainer plate 66 is retained in position by insertion into grooves 72 adapted for this purpose and which are mounted on a portion 74 of the front 24 of the base compartment 12. The grooves 72 facilitate the sliding engagement of the plate 66 when it is inserted in a direction shown by the arrow 76 in FIG. 2.

The cooler 10 preferably has at least two accessible carrier handles 78 foldable along the outer sides 80 of the generally rectangular container 26.

The insulated cover 32 of the container 26 is preferably a waffle-design cover 32 adapted to support at least about 300 pounds without breakage. The cover 32, as shown in FIGS. 1 and 2 may be connected by at least one hinge 82 to the container 26 at the rear 84 of the container 26 and have a positive locking latch 86 at the front 88 of the container 26 and cover 32.

The cooler 10, in its insulated portions preferably comprises a high-density polyurethane-type foam insulation. In operation, a coolant such as ice is placed in the container 26 wherein may also be placed items for cooling, for example beverage cans or freshly caught fish. The container 26 also has means for draining liquids such as water from melted ice. One such means is shown in FIG. 1 as a recessed drip-proof drain plug 90 in portion 92 of the insulated wall 28 in proximity to the top 20 of the base compartment 12.

To further describe the operation and advantages of the cooler 10, items or beverages, such as volumes of liquid or in bottles, for example, may be placed in a bin 34 where they are separated from coolant in the container 26 but are yet kept cool because of the non-insulated top 20 of the base compartment 12 or bottom 27 of the container 26. The bin 34 is preferably adapted to contain about one gallon of liquid.

The bottom 27 of the container 26 and top 20 of the base compartment 12 are both defined as a transverse partition 92 which preferably is a substantially non-insulating but impermeable material.

Changes may be made in the construction, operation and arrangement of the various parts, elements, steps and procedures described herein without departing from the concept and scope of the invention as defined in the following claims.

What is claimed is:

1. A portable cooler comprising:

a base compartment having insulated walls, an insulated bottom, at least one accessible recess and a top;

a generally rectangular container having insulated walls secured to and extending upwardly from the top of said base compartment and a bottom, the bottom being a transverse partition also indentified as the top of the base compartment;

at least two closable bins slidably insertable into the recesses of said base in a position generally beneath said rectangular container, said bins being fully removable from said recesses, having upward openings with lids slidably or hingedly attached thereto, each said bin further having walls and means for draining liquids from the bin by way of a drip-proof spigot in one of the walls in a position to be accessible when the bin is inserted into a recess to the base compartment;

means for draining liquid from said container; and means for covering said container.

2. The portable cooler of claim 1 wherein the means for draining liquid from said container is defined further as comprising a recessed drip-proof drain plug recessed in a portion of the insulated wall in proximity to the top of the base compartment.

3. The portable cooler of claim 1 wherein the means for covering said container is defined further as being an insulated cover.

4. The portable cooler of claim 3 wherein the insulated cover is defined further as being hingedly attached to an insulated wall of the container.

5. The portable cooler of claim 1 defined further as having at least two accessible carrying handles.

6. A portable cooler comprising:

(a) a base compartment with an insulated bottom, insulated walls, at least one laterally accessible recess, and a non-insulated top comprising a transverse partition;

(b) a generally rectangular container having insulated walls secured to the insulated walls of the base compartment and extending upwardly therefrom, a bottom comprising the transverse partition of the base, means for draining liquid therefrom and an insulated cover;

(c) at least one closable bin adapted to be reversibly inserted into the accessible recess of the base compartment, said closable bin being fully removable from said base compartment, said closable bin having an upward opening for transfer of items, a lid to reversibly cover the opening and means for draining liquid from the bin.

* * * * *